US008019259B2

(12) United States Patent
Ooyoshi et al.

(10) Patent No.: US 8,019,259 B2
(45) Date of Patent: Sep. 13, 2011

(54) DEVELOPMENT DEVICE, PROCESS UNIT, AND IMAGE FORMING APPARATUS

(75) Inventors: Hirobumi Ooyoshi, Toyonaka (JP); Yoshiyuki Shimizu, Nishinomiya (JP); Osamu Saito, Toyonaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/656,006

(22) Filed: Jan. 13, 2010

(65) Prior Publication Data

US 2010/0202796 A1 Aug. 12, 2010

(30) Foreign Application Priority Data

Feb. 6, 2009 (JP) ..... 2009-026490

(51) Int. Cl.
*G03G 15/08* (2006.01)

(52) U.S. Cl. ..... 399/279; 399/111

(58) Field of Classification Search ..... 399/119, 399/279, 111, 265; 384/256, 260, 247
See application file for complete search history.

(56) References Cited

U.S. PATENT DOCUMENTS

| | | | |
|---|---|---|---|
| 6,549,736 | B2 * | 4/2003 | Miyabe et al. |
| 7,424,263 | B2 * | 9/2008 | Shimizu et al. |
| 2007/0104523 | A1 * | 5/2007 | Yoshida et al. |
| 2007/0140763 | A1 * | 6/2007 | Shimizu et al. |
| 2007/0248390 | A1 * | 10/2007 | Kubota et al. |
| 2008/0145108 | A1 * | 6/2008 | Yoshida et al. |
| 2008/0145109 | A1 * | 6/2008 | Murayama et al. |
| 2008/0145119 | A1 * | 6/2008 | Tatsumi et al. |
| 2008/0170898 | A1 * | 7/2008 | Shimizu et al. |
| 2008/0187358 | A1 * | 8/2008 | Kubota et al. |
| 2008/0205930 | A1 * | 8/2008 | Kawakami et al. |
| 2008/0219698 | A1 * | 9/2008 | Shimizu et al. |
| 2008/0267661 | A1 * | 10/2008 | Yoshida et al. |
| 2008/0279581 | A1 * | 11/2008 | Shimizu |
| 2008/0279586 | A1 * | 11/2008 | Tatsumi et al. |
| 2009/0022531 | A1 * | 1/2009 | Kubota et al. |
| 2009/0110430 | A1 * | 4/2009 | Kubota et al. |
| 2009/0154973 | A1 * | 6/2009 | Shimizu et al. |
| 2009/0162101 | A1 * | 6/2009 | Yoshida et al. |
| 2009/0169246 | A1 * | 7/2009 | Ooyoshi et al. |
| 2009/0169265 | A1 * | 7/2009 | Yoshida et al. |
| 2009/0324263 | A1 * | 12/2009 | Shimizu et al. |

FOREIGN PATENT DOCUMENTS

| | | | |
|---|---|---|---|
| JP | 08030100 | A * | 2/1996 |
| JP | 09-269650 | | 10/1997 |
| JP | 2001-056587 | | 2/2001 |
| JP | 2002-156831 | | 5/2002 |
| JP | 2005157116 | A * | 6/2005 |
| JP | 2008-139818 | | 6/2008 |

* cited by examiner

*Primary Examiner* — David P Porta
*Assistant Examiner* — Milton Gonzalez
(74) *Attorney, Agent, or Firm* — Harness, Dickey & Pierce, P.L.C.

(57) ABSTRACT

A development device includes a developer carrier, a bearing member, a biasing member, and a guide. The developer carrier supplies a developer to an electrostatic latent image formed on an image carrier to develop the electrostatic latent image into a toner image. The bearing member rotatably supports the developer carrier axially. The biasing member is provided on a side of the bearing member opposite the image carrier to apply a force to the bearing member to move the bearing member and the developer carrier toward the image carrier. The guide is disposed about the bearing member to enable the bearing member to move therebetween and guide the bearing member toward the image carrier. The bearing member includes a rotatable part to rotate and slide over the guide while contacting the guide.

11 Claims, 14 Drawing Sheets

DEVELOPMENT DEVICE, PROCESS UNIT, AND IMAGE FORMING APPARATUS

PRIORITY STATEMENT

The present patent application claims priority from Japanese Patent Application No. 2009-026490, filed on Feb. 6, 2009, in the Japan Patent Office, which is hereby incorporated herein by reference in its entirety.

BACKGROUND OF THE INVENTION

1. Field of the Invention

Example embodiments generally relate to a development device, a process unit, and an image forming apparatus, and more particularly, to a development device for supplying developer to an image carrier, and a process unit and an image forming apparatus including the development device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIG. 1 illustrates a development device 6R included in such image forming apparatus. In the development device 6R, a toner agitator 5R is rotatably provided in a toner hopper 7R to rotate and agitate developer including toner in the toner hopper 7R. A supply roller 4R rotates in a rotation direction identical to a rotation direction of a development roller 3R to supply the toner in the toner hopper 7R to the development roller 3R. A front edge of a blade 2R, which contacts and presses against the surface of the development roller 3R serving as a developer carrier forms the toner adhered to the surface of the development roller 3R into a uniform thin toner layer. The development roller 3R contacts a photoconductor 1R and transfers the toner forming the thin toner layer on the development roller 3R onto the surface of the photoconductor 1R, where the transferred toner is attracted and adhered to an electrostatic latent image formed on the photoconductor 1R serving as an image carrier. Thus, a toner image is formed on the photoconductor 1R for ultimate transfer to a recording medium to form a final image.

In the development device 6R, the state of contact between the development roller 3R and the photoconductor 1R is critical to proper image formation. If the development roller 3R separates even momentarily from the photoconductor 1R, the development roller 3R does not transfer the toner to the photoconductor 1R properly, resulting in formation of a faulty toner image. By contrast, when the development roller 3R is pressed against the photoconductor 1R strongly, an excessively solid toner image is formed on the photoconductor 1R.

To address this problem, the development device 6R may include a biasing member 8R to press the development roller 3R against the photoconductor 1R at constant pressure, as illustrated in FIGS. 2A and 2B. Bearings 9R are provided on both ends of an axle or shaft of the development roller 3R. The biasing member 8R, which may be a spring, presses against the bearing 9R, which in turn presses the development roller 3R supported by the bearing 9R against the photoconductor 1R. With such an arrangement, the development roller 3R adjusts a distance between a shaft of the photoconductor 1R and the shaft of the development roller 3R to maintain constant pressure of contact between the development roller 3R and the photoconductor 1R, for example, when the distance between the shaft of the photoconductor 1R and the shaft of the development roller 3R is shorter, as is a distance D1 illustrated in FIG. 2A, or longer, as is a distance D2 illustrated in FIG. 2B. Accordingly, even when rotation of the photoconductor 1R or the development roller 3R is eccentric or either one of these members is misshapen, the development roller 3R is still pressed against the photoconductor 1R with constant pressure.

The development device 6R may further include a U-shaped guide 10R as illustrated in FIGS. 3A and 3B, with the bearing 9R movably provided inside the guide 10R. As illustrated in FIG. 3B, when the development roller 3R rotates, a force F generated in accordance with rotation of the development roller 3R causes the bearing 9R to contact an interior wall of the guide 10R. The bearing 9R slides over the interior wall of the guide 10R as the distance between the photoconductor 1R and the development roller 3R changes.

However, the bearing 9R sliding over the interior wall of the guide 10R generates friction between the bearing 9R and the guide 10R. When the friction is greater than the force applied by the biasing member 8R or when the friction prevents the bearing 9R from sliding over the guide 10R smoothly, the development roller 3R may lose contact with the photoconductor 1R momentarily, resulting in formation of a faulty toner image as described above.

To counteract this problem, the biasing member 8R can be made to apply greater force to the bearing 9R. However, the greater force may press the development roller 3R against the photoconductor 1R with greater pressure, resulting in a shortened service life for the photoconductor 1R due to excessive wear and formation of a faulty toner image due to degradation of toner carried by the photoconductor 1R.

SUMMARY

At least one embodiment may provide a development device that includes a developer carrier, a bearing member, a biasing member, and a guide. The developer carrier supplies a developer to an electrostatic latent image formed on an image carrier to develop the electrostatic latent image into a toner image. The bearing member rotatably supports the developer carrier axially. The biasing member is provided on a side of the bearing member opposite the image carrier to apply a force to the bearing member to move the bearing member and the developer carrier toward the image carrier. The guide is disposed about the bearing member to enable the bearing member to move therebetween and guide the bearing member toward the image carrier. The bearing member includes a rotatable part to rotate and slide over the guide while contacting the guide.

At least one embodiment may provide a process unit detachably attached to an image forming apparatus. The process unit includes an image carrier for carrying an electrostatic latent image, and a development device. The development device includes a developer carrier, a bearing member, a biasing member, and a guide. The developer carrier supplies a developer to the electrostatic latent image formed on the image carrier to develop the electrostatic latent image into a toner image. The bearing member rotatably supports the developer carrier axially. The biasing member is provided on a side of the bearing member opposite the image carrier to apply a force to the bearing member to move the bearing member and the developer carrier toward the image carrier. The guide is disposed about the bearing member to enable the bearing member to move therebetween and guide the bearing member toward the image carrier. The bearing member includes a rotatable part to rotate and slide over the guide while contacting the guide.

At least one embodiment may provide an image forming apparatus that includes a development device including a developer carrier, a bearing member, a biasing member, and a guide. The developer carrier supplies a developer to an electrostatic latent image formed on an image carrier to develop the electrostatic latent image into a toner image. The bearing member rotatably supports the developer carrier axially. The biasing member is provided on a side of the bearing member opposite the image carrier to apply a force to the bearing member to move the bearing member and the developer carrier toward the image carrier. The guide is disposed about the bearing member to enable the bearing member to move therebetween and guide the bearing member toward the image carrier. The bearing member includes a rotatable part to rotate and slide over the guide while contacting the guide.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
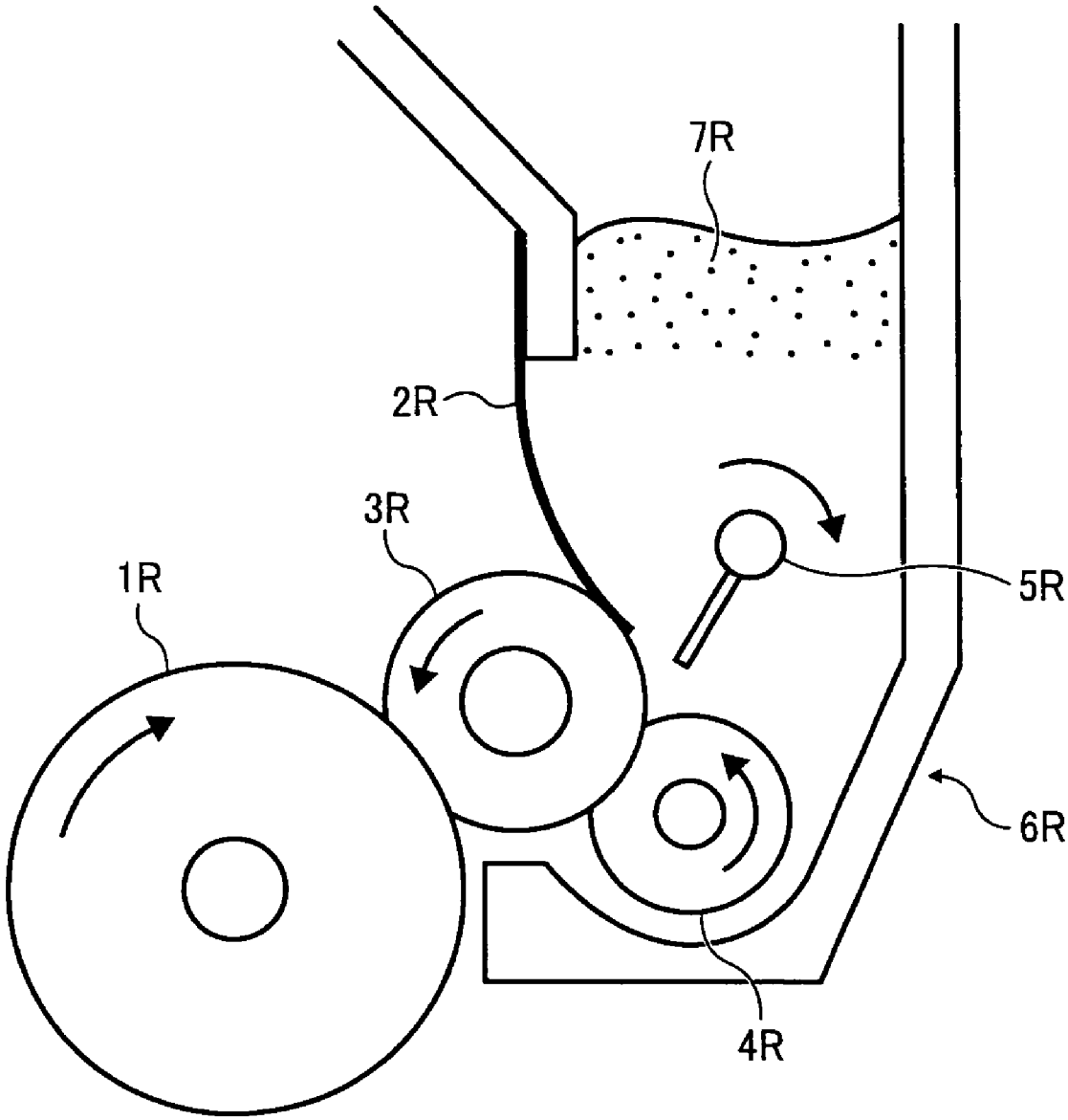
FIG. 1 RELATED ART
FIG. 1 is a schematic view of a related art development device and a photoconductor.
Figure 2A:
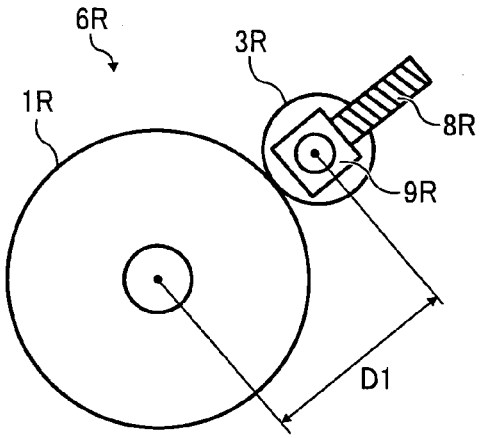
FIG. 2A RELATED ART
FIG. 2A is an enlarged view of the related art development device and the photoconductor shown in FIG. 1 for explaining movement of a development roller included in the development device with respect to the photoconductor.
Figure 2B:
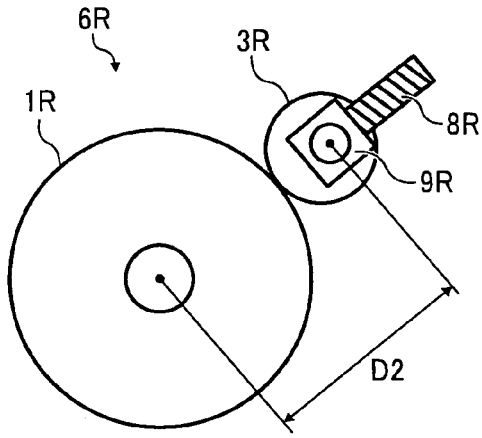
FIG. 2B RELATED ART
FIG. 2B is another enlarged view of the related art development device and the photoconductor shown in FIG. 1 for explaining movement of a development roller included in the development device with respect to the photoconductor.
Figure 3A:
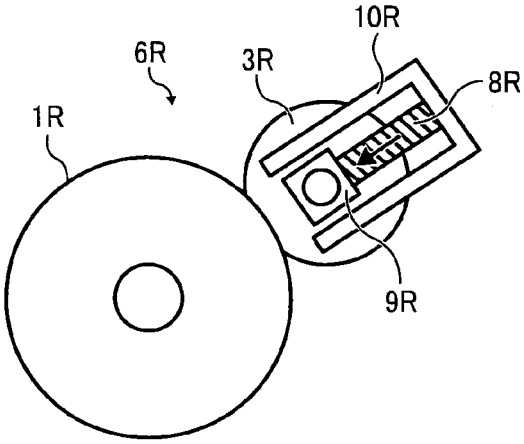
FIG. 3A RELATED ART
FIG. 3A is an enlarged view of the related art development device and the photoconductor shown in FIG. 1 for explaining movement of a bearing included in the development device.
Figure 3B:
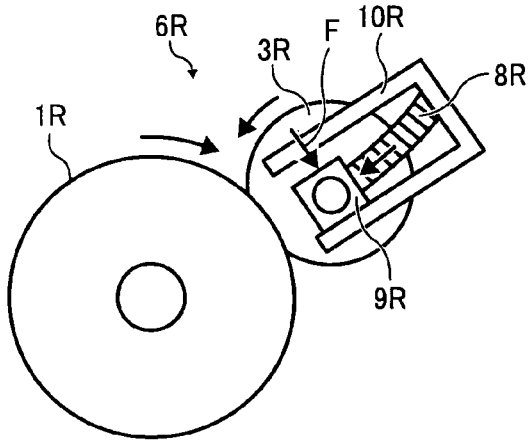
FIG. 3B RELATED ART
FIG. 3B is another enlarged view of the related art development device and the photoconductor shown in FIG. 1 for explaining movement of a bearing included in the development device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to"

another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 4:
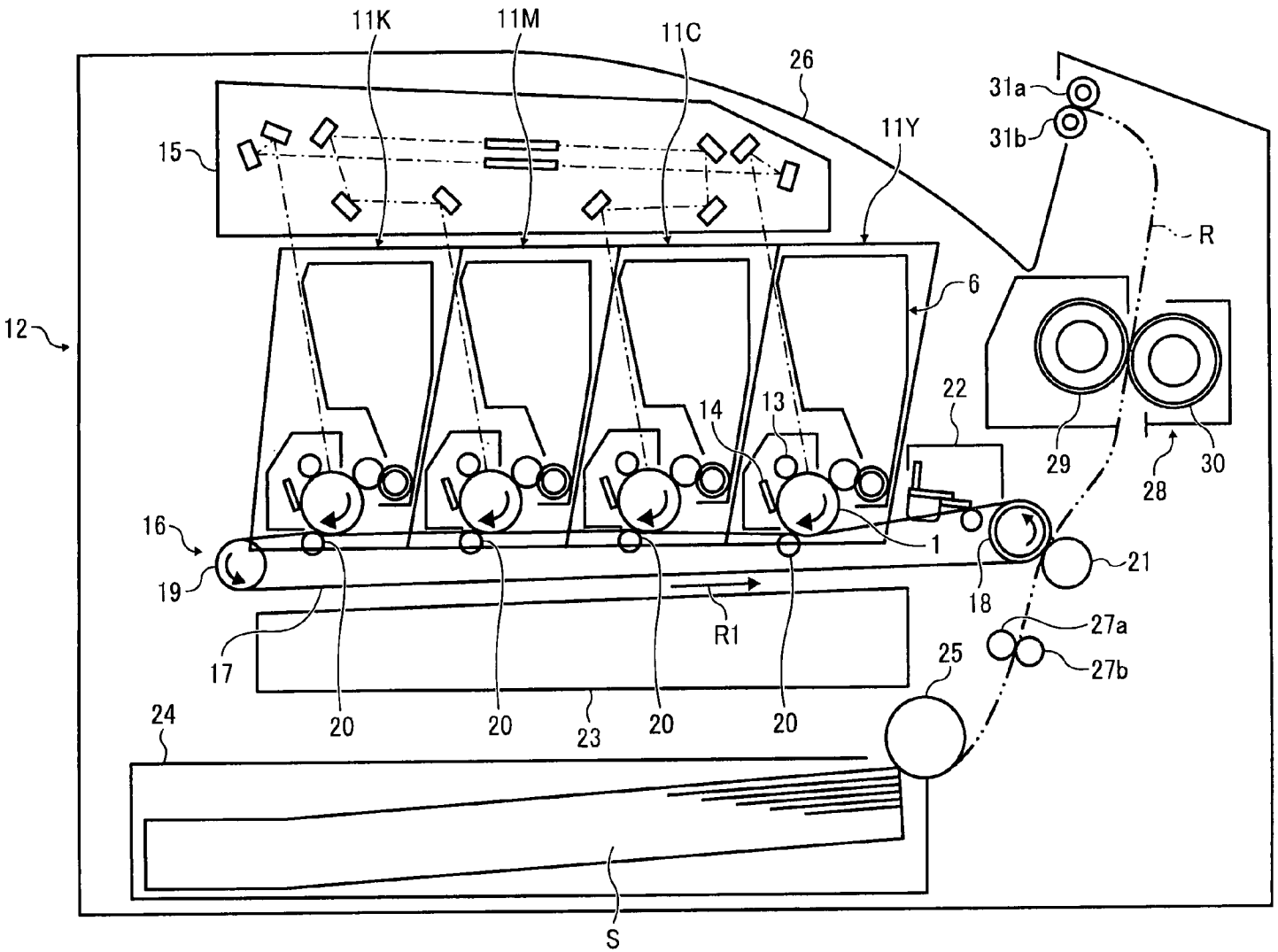
FIG. 4 is a schematic view of an image forming apparatus according to an example embodiment.

Referring now to the drawings, wherein like reference numerals designate identical or corresponding parts throughout the several views, particularly to FIG. 4, an image forming apparatus 12 according to an example embodiment is explained.

FIG. 4 is a schematic view of the image forming apparatus 12. As illustrated in FIG. 4, the image forming apparatus 12 includes process units 11Y, 11C, 11M, and 11K, an exposure device 15, an intermediate transfer unit 16, a second transfer roller 21, a belt cleaner 22, a waste toner container 23, a recording media container 24, a feed roller 25, a stock portion 26, registration rollers 27*a* and 27*b*, a fixing device 28, output rollers 31*a* and 31*b*, and/or a conveyance path R.

The process unit 11Y includes a photoconductor 1, a development device 6, a charging roller 13, and/or a cleaning blade 14. The intermediate transfer unit 16 includes an intermediate transfer belt 17, a driving roller 18, a driven roller 19, and/or first transfer rollers 20. The fixing device 28 includes a heating roller 29 and/or a pressing roller 30.

As illustrated in FIG. 4, the image forming apparatus 12 may be a copier, a facsimile machine, a printer, a multifunction printer having at least one of copying, printing, scanning, plotter, and facsimile functions, or the like. The image forming apparatus 12 may form a color image and/or a monochrome image by electrophotography. According to this example embodiment of the present invention, the image forming apparatus 12 functions as a copier for forming a color image on a recording medium by electrophotography.

The four process units 11Y, 11C, 11M, and 11K are detachably attached to the image forming apparatus 12. The process units 11Y, 11C, 11M, and 11K contain and use toners in different colors (e.g., yellow, cyan, magenta, and black colors corresponding to color separation components of a color image), respectively, but have a similar structure. Accordingly, the following describes the structure of the process unit 11Y which is equivalent to the structure of the process units 11C, 11M, and 11K.

In the process unit 11Y, the photoconductor 1 serves as an image carrier. The charging roller 13 serves as a charger for charging a surface of the photoconductor 1. The development device 6 serves as a development device for supplying a developer (e.g., toner) to the surface of the photoconductor 1. The cleaning blade 14 serves as a cleaner for cleaning the surface of the photoconductor 1.

The exposure device 15 is provided above the process units 11Y, 11C, 11M, and 11K, and exposes the charged surface of the photoconductor 1. The intermediate transfer unit 16 is provided below the process units 11Y, 11C, 11M, and 11K. In the intermediate transfer unit 16, the intermediate transfer belt 17 serving as an endless belt is stretched over the driving roller 18 and the driven roller 19, and moves and rotates in a direction R1.

The four first transfer rollers 20, serving as first transfer members, oppose the photoconductors 1 of the process units 11Y, 11C, 11M, and 11K, respectively. The first transfer rollers 20 are pressed against the photoconductors 1 via the intermediate transfer belt 17 to form first transfer nip portions between the photoconductors 1 and the intermediate transfer belt 17, respectively. The second transfer roller 21, serving as a second transfer member, opposes the driving roller 18. The second transfer roller 21 is pressed against the driving roller 18 via the intermediate transfer belt 17 to form a second transfer nip portion between the second transfer roller 21 and the intermediate transfer belt 17.

The belt cleaner 22 faces an outer circumferential surface of the intermediate transfer belt 17. A waste toner conveyance hose extending from the belt cleaner 22 is connected to an inlet of the waste toner container 23 provided below the intermediate transfer unit 16 to connect the belt cleaner 22 to the waste toner container 23.

The recording media container 24 and the feed roller 25 are provided in a lower portion of the image forming apparatus 12. The recording media container 24 contains recording media S, such as paper and OHP transparencies. The feed roller 25 feeds the recording media S one by one from the recording media container 24. A recording medium S fed from the recording media container 24 is conveyed toward the stock portion 26 provided on top of the image forming apparatus 12 through the conveyance path R provided inside the image forming apparatus 12. A pair of registration rollers 27*a* and 27*b* is provided between the feed roller 25 and the second transfer roller 21 in the conveyance path R. The fixing device 28 is provided in the conveyance path R at a position downstream from the second transfer roller 21 in a recording medium conveyance direction, that is, at a position above the second transfer roller 21 in FIG. 4. The fixing device 28 fixes a toner image on a recording medium S. In the fixing device 28, the heating roller 29 and the pressing roller 30 are pressed against each other to form a fixing nip portion between the heating roller 29 and the pressing roller 30. A pair of output rollers 31*a* and 31*b* is provided at a downstream end of the conveyance path R in the recording medium conveyance direction, and outputs the recording medium S bearing the fixed toner image to an outside of the image forming apparatus 12.

Referring to FIG. 4, the following describes an image forming operation of the image forming apparatus 12. When the image forming apparatus 12 receives a command to start an image forming operation, a driver drives and rotates the photoconductors 1 of the process units 11Y, 11C, 11M, and 11K clockwise in FIG. 4. In the process units 11Y, 11C, 11M, and 11K, the charging rollers 13 uniformly charge the surfaces of the photoconductors 1 to have a reference polarity, respectively. The exposure device 15 emits laser beams onto the charged surfaces of the photoconductors 1 to form electrostatic latent images on the surfaces of the photoconductors 1 according to image data corresponding to yellow, cyan, magenta, and black colors generated by separating a full-color image data, respectively. The development devices 6 supply yellow, cyan, magenta, and black toners to the electrostatic latent images formed on the photoconductors 1 to make the electrostatic latent images visible as yellow, cyan, magenta, and black toner images, respectively.

A driver drives and rotates the driving roller 18 supporting the intermediate transfer belt 17 counterclockwise in FIG. 4 to move and rotate the intermediate transfer belt 17 in the direction R1. A voltage controlled to have a constant voltage or current of a polarity opposite to a polarity of the toners is applied to the first transfer rollers 20 so as to generate a transfer electric field at the first transfer nip portions between the first transfer rollers 20 and the photoconductors 1, respectively. The transfer electric field generated at the first transfer nip portions transfers the yellow, cyan, magenta, and black toner images formed on the photoconductors 1 of the process units 11Y, 11C, 11M, and 11K, respectively, onto the outer circumferential surface of the intermediate transfer belt 17 in such a manner that the yellow, cyan, magenta, and black toner images are superimposed on a same position on the intermediate transfer belt 17 sequentially. Thus, a full-color toner image is formed on the intermediate transfer belt 17.

The cleaning blades 14 remove residual toners remaining on the surfaces of the photoconductors 1 from the surfaces of the photoconductors 1 after the yellow, cyan, magenta, and black toner images are transferred from the photoconductors 1 onto the intermediate transfer belt 17, respectively. Dischargers discharge the surfaces of the photoconductors 1 to initialize a surface potential of the photoconductors 1 so that the photoconductors 1 are ready for a next image forming operation.

The feed roller 25 rotates and feeds a recording medium S contained in the recording media container 24 toward the registration rollers 27*a* and 27*b* in the conveyance path R. The registration rollers 27*a* and 27*b* feed the recording medium S toward the second transfer nip portion formed between the second transfer roller 21 and the opposing driving roller 18 via the intermediate transfer belt 17 at a proper time. A transfer voltage having a polarity opposite to the polarity of the toners forming the full-color toner image formed on the intermediate transfer belt 17 is applied to the second transfer roller 21 so as to generate a transfer field at the second transfer nip portion between the second transfer roller 21 and the intermediate transfer belt 17. The transfer field generated at the second transfer nip portion transfers the full-color toner image formed on the intermediate transfer belt 17 onto the recording medium S at a time. The recording medium S bearing the full-color toner image is sent to the fixing device 28. When the recording medium S bearing the full-color toner image passes through the fixing nip portion between the heating roller 29 and the pressing roller 30, the heating roller 29 and the pressing roller 30 apply heat and pressure to the recording medium S to melt and fix the full-color toner image on the recording medium S. The recording medium S bearing the fixed full-color toner image is sent to the output rollers 31*a* and 31*b* so that the output rollers 31*a* and 31*b* output the recording medium S onto the stock portion 26. The belt cleaner 22 removes residual toner remaining on the intermediate transfer belt 17 from the intermediate transfer belt 17 after the full-color toner image is transferred onto the recording medium S. The removed toner is sent and collected into the waste toner container 23.

The above-described image forming operation forms the full-color toner image on the recording medium S. Alternatively, the image forming apparatus 12 may form a monochrome toner image by using one of the four process units 11Y, 11C, 11M, and 11K, or may form a two-color toner image or a three-color toner image by using two or three of the four process units 11Y, 11C, 11M, and 11K.

Figure 5:
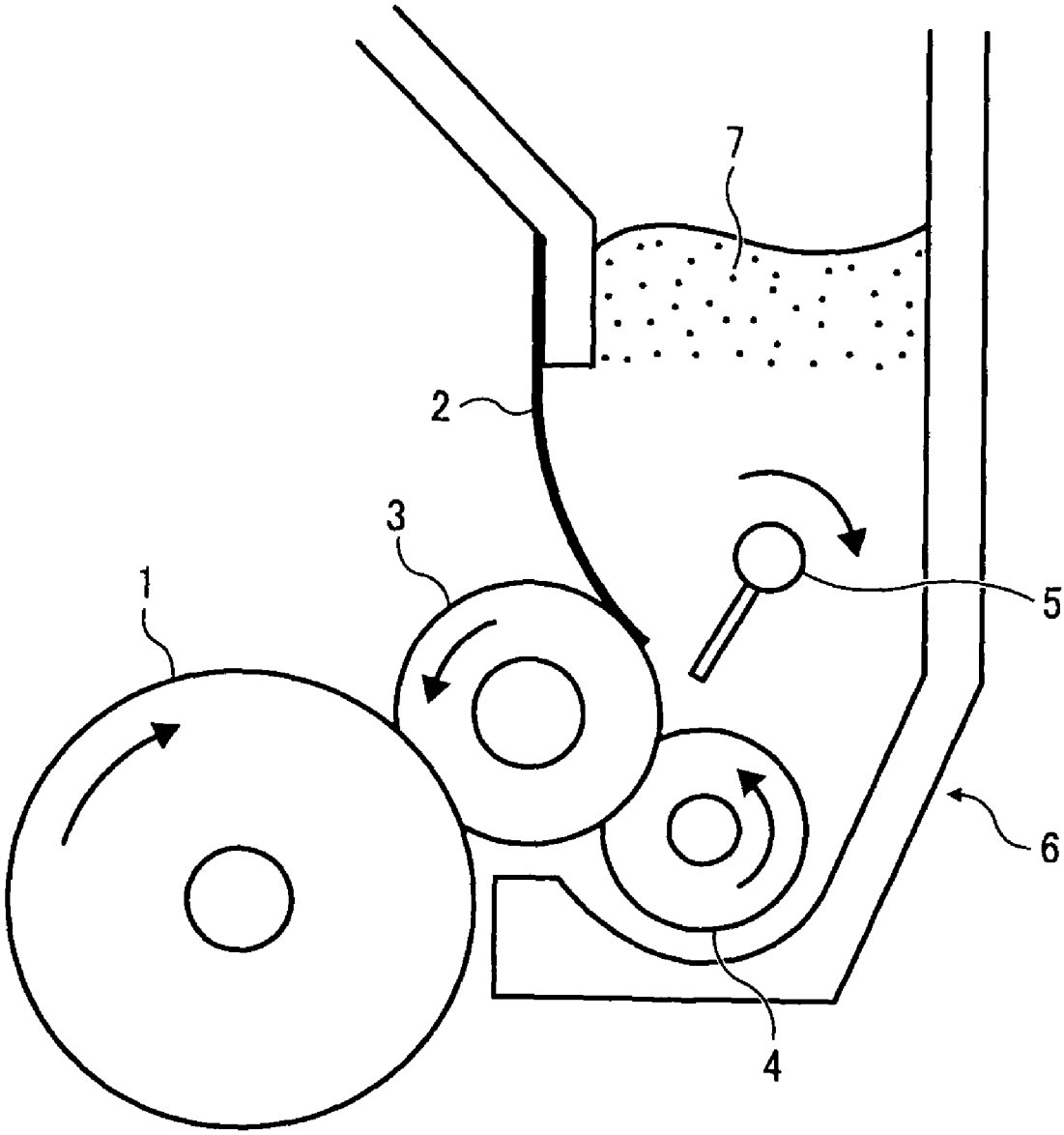
FIG. 5 is a schematic view (according to an example embodiment) of a development device included in the image forming apparatus shown in FIG. 4.

FIG. 5 is a schematic view of the development device 6. As illustrated in FIG. 5, the development device 6 includes a blade 2, a development roller 3, a supply roller 4, a toner agitator 5, and/or a toner hopper 7.

The development roller 3 serves as a developer carrier. The supply roller 4 serves as a rotary member including a sponge layer as an outer circumferential surface layer. The supply roller 4 rotates in a rotation direction identical to a rotation direction of the development roller 3 to supply toner received by the sponge layer to the development roller 3. The blade 2 includes a metal plate spring. A front edge of the blade 2, which contacts and presses a surface of the development roller 3, forms toner adhered to the surface of the development roller 3 into a uniform thin toner layer. The toner agitator 5 is rotatably provided in the toner hopper 7. The rotating toner agitator 5 agitates toner in the toner hopper 7. The development roller 3 serves as a rotary member including a rubber layer as an outer circumferential surface layer. The development roller 3 contacts the surface of the photoconductor 1 and transfers the toner forming the uniform thin toner layer on the surface of the development roller 3 onto the surface of the photoconductor 1. The transferred toner is adhered to an electrostatic latent image formed on the photoconductor 1 so that a toner image is formed on the photoconductor 1.

Figure 6:
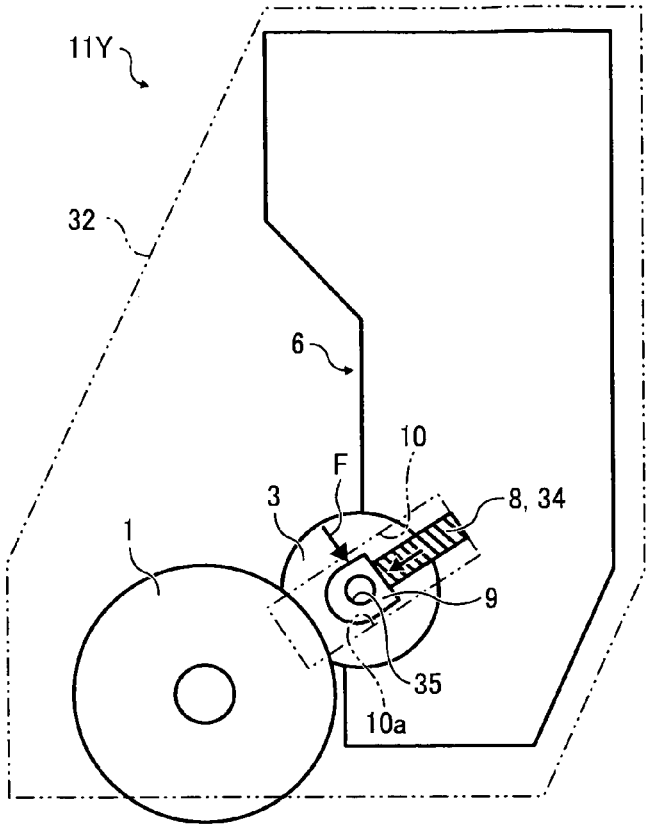
FIG. 6 is a schematic view (according to an example embodiment) of a process unit included in the image forming apparatus shown in FIG. 4.
Figure 7:
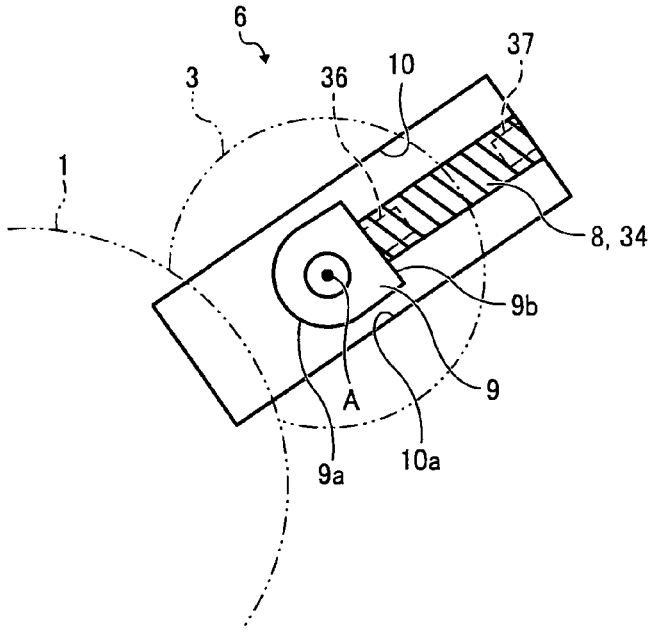
FIG. 7 is an enlarged view (according to an example embodiment) of the development device shown in FIG. 5.

Referring to FIGS. 6 and 7, the following describes features of the development device 6. FIG. 6 is a schematic view of the process unit 11Y including the development device 6 and a support mechanism for supporting the development device 6. As illustrated in FIG. 6, the process unit 11Y further includes side plates 32. The development device 6 further includes a biasing member 8, a bearing 9, a hole 35, and/or a guide 10. The biasing member 8 includes a coil spring 34. The guide 10 includes a contact surface portion 10*a*.

The development device 6 is rotatably supported between a pair of side plates 32. The photoconductor 1 is also rotatably supported between the pair of side plates 32. For example, both ends of a shaft of the photoconductor 1 in an axial direction of the photoconductor 1 are inserted into through-holes provided in the side plates 32, respectively, in such a manner that the photoconductor 1 is rotatably supported by the side plates 32. The side plates 32 support the development roller 3 via a pair of bearings 9 serving as a bearing member. For example, both ends of a shaft of the development roller 3 in an axial direction of the development roller 3 are inserted into the holes 35 provided in the bearings 9, respectively, in such a manner that the development roller 3 is rotatably supported by the bearings 9.

The guide 10 is provided in each of the side plates 32, and extends in a direction perpendicular to the axial direction of the photoconductor 1. The guide 10 may include a hole with a bottom, a through-hole, or a groove provided between a pair of protrusions disposed in such a manner that a predetermined gap is provided between the protrusions. The guide 10 houses the bearing 9 in such a manner that the bearing 9 moves closer to and away from the photoconductor 1 inside the guide 10 in the direction perpendicular to the axial direction of the photoconductor 1.

When the development roller 3 rotates to form a toner image, a force F generated in accordance with rotation of the development roller 3 causes the bearing 9 to contact an interior wall of the guide 10, that is, the contact surface portion 10*a*opposing a direction of the force F. In other words, when the development roller 3 rotates, the bearing 9 is guided along the contact surface portion 10*a* of the guide 10. The biasing member 8 is provided inside the guide 10. According to this example embodiment, the biasing member 8 includes the coil spring 34. The coil spring 34 applies a force to the bearing 9 to move the bearing 9 toward the photoconductor 1 so that the development roller 3 supported by the bearing 9 is pressed against the photoconductor 1 with predetermined pressure.

FIG. 7 is an enlarged view of the development device 6. As illustrated in FIG. 7, the development device 6 further includes protrusions 36 and 37. The bearing 9 includes an arc-shaped outer circumferential surface portion 9*a* and/or a plane surface portion 9*b*.

The arc-shaped outer circumferential surface portion 9*a* serving as an arc-shaped outer circumferential portion of the bearing 9 faces the photoconductor 1, and is disposed concentrically with a rotation axis A of the development roller 3 supported by the bearing 9. The coil spring 34 is attached to the plane surface portion 9*b* of the bearing 9 provided opposite to the arc-shaped outer circumferential surface portion 9*a*. For example, one end of the coil spring 34 in the direction perpendicular to the axial direction of the development roller 3 engages the protrusion 36 provided on the plane surface portion 9*b* of the bearing 9. Another end of the coil spring 34 in the direction perpendicular to the axial direction of the development roller 3 engages the protrusion 37 provided inside the guide 10.

Figure 8:
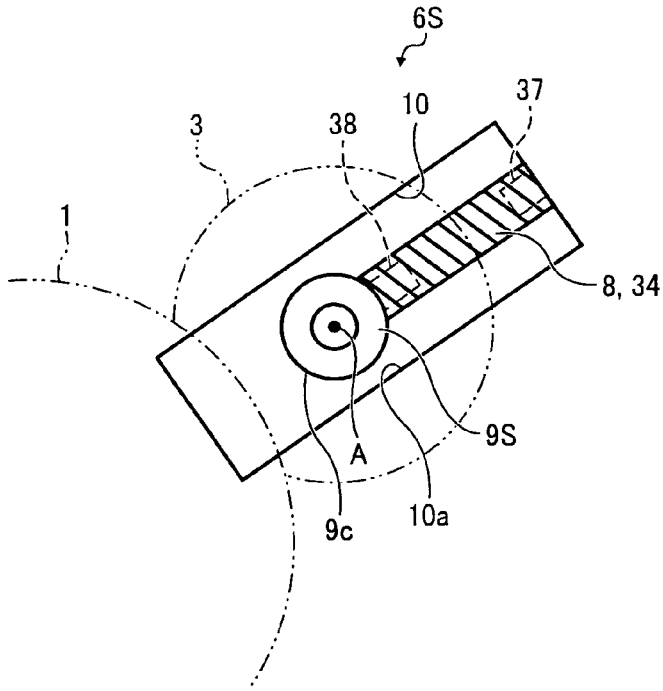
FIG. 8 is an enlarged view of a development device according to another example embodiment.

FIG. 8 is an enlarged view of a development device 6S according to another example embodiment. As illustrated in FIG. 8, the development device 6S includes a bearing 9S and/or a protrusion 38. The bearing 9S includes a circular outer circumferential surface portion 9*c*. The bearing 9S replaces the bearing 9 depicted in FIG. 7. The protrusion 38 replaces the protrusion 36 depicted in FIG. 7. The other elements of the development device 6S are equivalent to the elements of the development device 6 depicted in FIG. 7.

Unlike the bearing 9 depicted in FIG. 7, the bearing 9S serving as a bearing member includes a roller member having the circular outer circumferential surface portion 9*c* serving as a circular outer circumferential portion. The circular outer circumferential surface portion 9*c* of the bearing 9S having a roller shape is disposed concentrically with the rotation axis A of the development roller 3 supported by the bearing 9S. The protrusion 38 is provided on the circular outer circumferential surface portion 9*c* of the bearing 9S. One end of the coil spring 34 in the direction perpendicular to the axial direction of the development roller 3 engages the protrusion 38.

Figure 9:
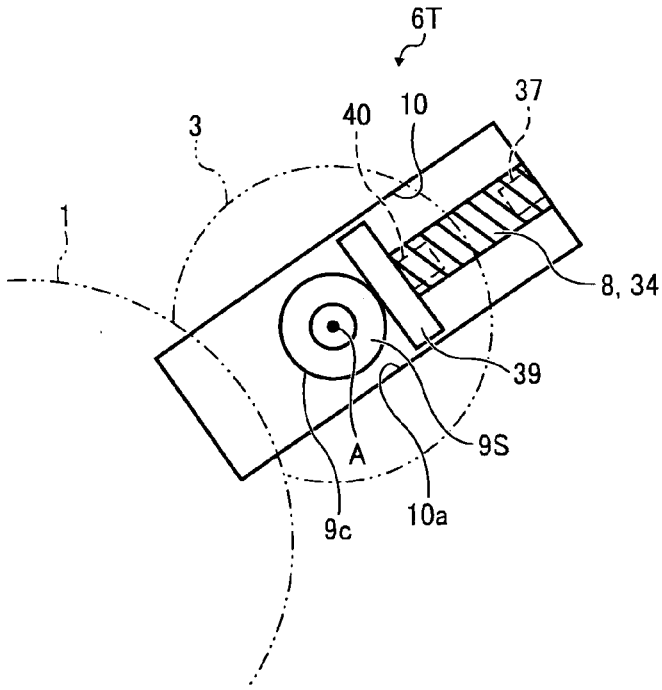
FIG. 9 is an enlarged view of a development device according to yet another example embodiment.

FIG. 9 is an enlarged view of a development device 6T according to yet another example embodiment. As illustrated in FIG. 9, the development device 6T includes a pressing member 39 and/or a protrusion 40. The pressing member 39 and the protrusion 40 replace the protrusion 38 depicted in FIG. 8. The other elements of the development device 6T are equivalent to the elements of the development device 6S depicted in FIG. 8.

The pressing member 39 having a plate shape is provided between the bearing 9S and the coil spring 34 provided inside the guide 10. The bearing 9S includes a roller member. The coil spring 34 applies a force to the bearing 9S via the pressing member 39 to move the bearing 9S toward the photoconductor 1. In the development device 6T, unlike in the development device 6 depicted in FIG. 7 and the development device 6S depicted in FIG. 8, the coil spring 34 is separated from the bearing 9S. In other words, one end of the coil spring 34 in the direction perpendicular to the axial direction of the development roller 3 is not attached to the bearing 9S, but engages the protrusion 40 provided on the pressing member 39.

The pressing member 39 and the bearing 9S may include a material having a low friction coefficient, such as POM (polyoxymethylene) resin, to decrease friction generated between the pressing member 39 and the bearing 9S. Like in the development device 6S depicted in FIG. 8, the circular outer circumferential surface portion 9*c* of the bearing 9S having a roller shape is disposed concentrically with the rotation axis A of the development roller 3 supported by the bearing 9S.

Figure 10:
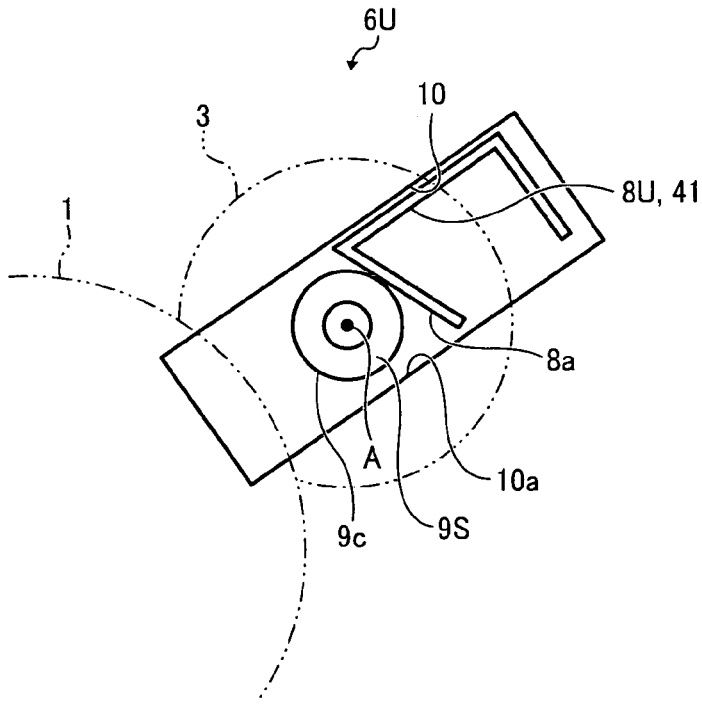
FIG. 10 is an enlarged view of a development device according to yet another example embodiment.

FIG. 10 is an enlarged view of a development device 6U according to yet another example embodiment. As illustrated in FIG. 10, the development device 6U includes a biasing member 8U. The biasing member 8U includes a pressing surface portion 8*a* and/or a plate spring 41. The biasing member 8U replaces the biasing member 8 depicted in FIG. 8. The development device 6U does not include the protrusions 37 and 38 depicted in FIG. 8. The other elements of the development device 6U are equivalent to the elements of the development device 6S depicted in FIG. 8.

The plate spring 41 serving as the biasing member 8U is provided inside the guide 10. The bearing 9S includes a roller member. The plate spring 41 is bent to have a U-like shape. One of bent ends of the plate spring 41 in the direction perpendicular to the axial direction of the development roller 3 applies a force to the bearing 9S to move the bearing 9S toward the photoconductor 1. For example, the pressing surface portion 8*a* serving as a pressing portion of the plate spring 41 directly presses against the bearing 9S. Accordingly, the development device 6U does not include the pressing member 39 depicted in FIG. 9.

The bearing 9S may include a material having a low friction coefficient to decrease friction generated between the bearing 9S and the plate spring 41. Like in the development device 6S depicted in FIG. 8 or the development device 6T depicted in FIG. 9, the circular outer circumferential surface portion 9*c* of the bearing 9S having a roller shape is disposed concentrically with the rotation axis A of the development roller 3 supported by the bearing 9S.

Figure 11:
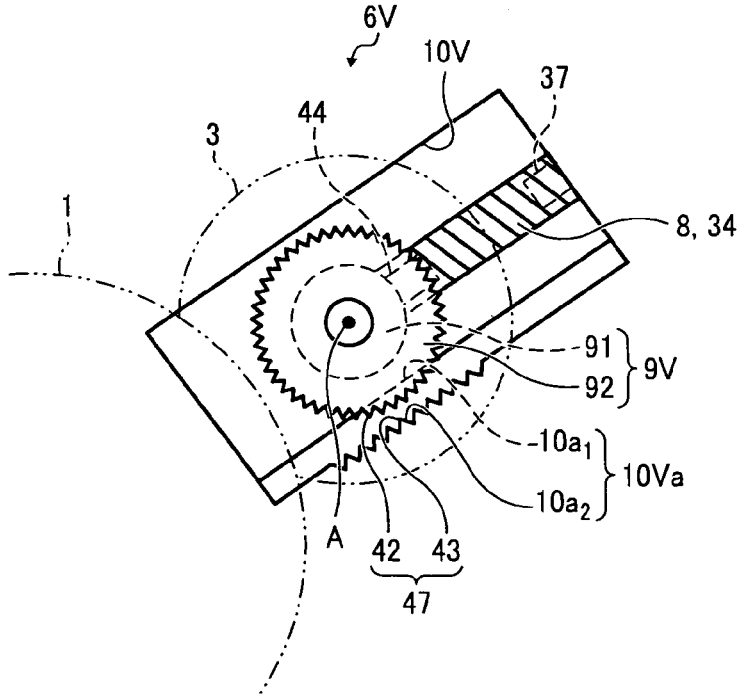
FIG. 11 is an enlarged view of a development device according to yet another example embodiment.

FIG. 11 is an enlarged view of a development device 6V according to yet another example embodiment. As illustrated in FIG. 11, the development device 6V includes a bearing 9V, a guide 10V, a protrusion 44, and/pr a slip stopper 47. The bearing 9V includes a small diameter portion 91 and/or a large diameter portion 92. The guide 10V includes a contact surface part 10Va. The contact surface part 10Va includes contact surface portions 10*a*1 and 10*a*2. The slip stopper 47 includes a circularly-arranged set of teeth 42 and/or a straight set of teeth 43.

The bearing 9V replaces the bearing 9S depicted in FIG. 8. The guide 10V replaces the guide 10 depicted in FIG. 8. The protrusion 44 replaces the protrusion 38 depicted in FIG. 8. The other elements of the development device 6V are equivalent to the elements of the development device 6S depicted in FIG. 8.

The small diameter portion 91 and the large diameter portion 92 of the bearing 9V serving as a bearing member are disposed concentrically with the rotation axis A of the development roller 3 supported by the bearing 9V. The small diameter portion 91 and the large diameter portion 92 are integrated into a unit. The circularly-arranged set of teeth 42 serving as a first set of teeth is provided on an outer circumferential surface of the large diameter portion 92, and includes a plurality of projections and depressions aligned in a circumferential direction of the circularly-arranged set of teeth 42. By contrast, no set of teeth is provided on an outer circumferential surface of the small diameter portion 91, but the protrusion 44 is provided on the outer circumferential surface of the small diameter portion 91 to engage one end of the coil spring 34 in the direction perpendicular to the axial direction of the development roller 3.

The contact surface part 10Va of the guide 10V includes two surface portions, which are the contact surface portions 10*a*1 and 10*a*2. When the development roller 3 rotates, the small diameter portion 91 of the bearing 9V contacts the contact surface portion 10*a*1 of the guide 10V, and the large diameter portion 92 of the bearing 9V contacts the contact surface portion 10*a*2 of the guide 10V. The straight set of teeth 43 serving as a second set of teeth is provided on the contact surface portion 10*a*2 contacted by the large diameter portion 92 of the bearing 9V, and includes a plurality of projections and depressions aligned in a straight line. When the large diameter portion 92 of the bearing 9V contacts the contact surface portion 10*a*2 of the guide 10V, the straight set of teeth 43 engages the circularly-arranged set of teeth 42. By contrast, no set of teeth is provided on the contact surface portion 10*a*1 contacted by the small diameter portion 91. Alternatively, the circularly-arranged set of teeth 42 may be provided on a part of the outer circumferential surface of the large diameter portion 92 to have an arc shape so as to engage the straight set of teeth 43.

Figure 12:
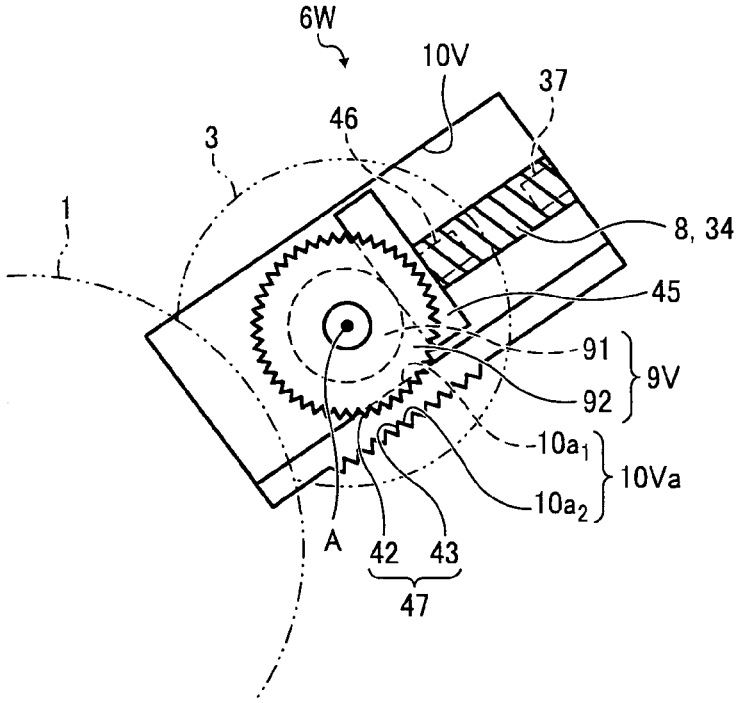
FIG. 12 is an enlarged view of a development device according to yet another example embodiment.

FIG. 12 is an enlarged view of a development device 6W according to yet another example embodiment. As illustrated in FIG. 12, the development device 6W includes a pressing member 45 and/or a protrusion 46. The pressing member 45 and the protrusion 46 replace the protrusion 44 depicted in FIG. 11. The other elements of the development device 6W are equivalent to the elements of the development device 6V depicted in FIG. 11.

Like the development device 6V depicted in FIG. 11, the development device 6W includes the bearing 9V provided with the circularly-arranged set of teeth 42 and the guide 10V provided with the straight set of teeth 43. The pressing member 45 presses against the small diameter portion 91 of the bearing 9V.

The coil spring 34 applies a force to the bearing 9V via the pressing member 45. Unlike in the development device 6V depicted in FIG. 11, in the development device 6W, one end of the coil spring 34 in the direction perpendicular to the axial direction of the development roller 3 engages the protrusion 46 provided on the pressing member 45. Therefore, the coil spring 34 is separated from the bearing 9V. The pressing member 45 and the bearing 9V may include a material having a low friction coefficient such as POM resin.

Figure 13:
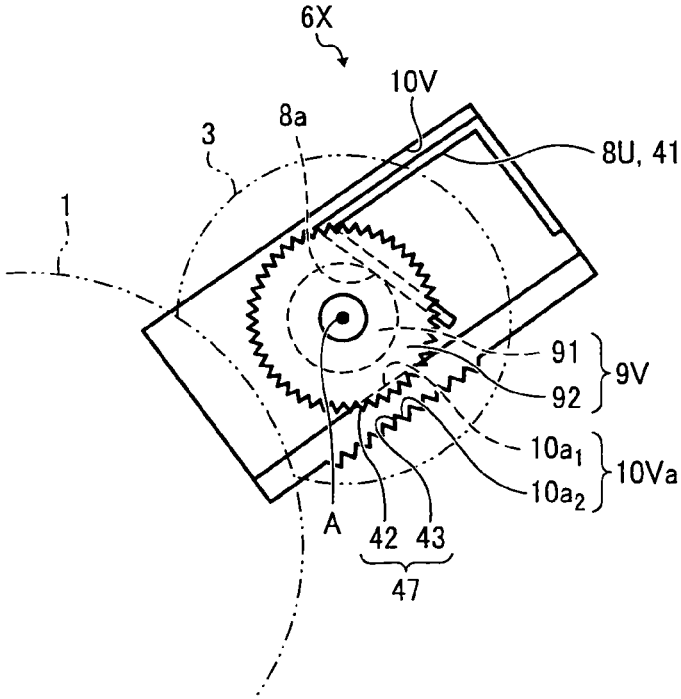
FIG. 13 is an enlarged view of a development device according to yet another example embodiment.

FIG. 13 is an enlarged view of a development device 6X according to yet another example embodiment. As illustrated in FIG. 13, the development device 6X includes the biasing member 8U including the pressing surface portion 8*a* and the plate spring 41. The biasing member 8U replaces the biasing member 8 depicted in FIG. 11. The development device 6X does not include the protrusions 37 and 44 depicted in FIG. 11. The other elements of the development device 6X are equivalent to the elements of the development device 6V depicted in FIG. 11.

Like the development devices 6V and 6W depicted in FIGS. 11 and 12, respectively, the development device 6X includes the bearing 9V provided with the circularly-arranged set of teeth 42 and the guide 10V provided with the straight set of teeth 43. The development device 6X further includes the plate spring 41 bent to have a U-like shape as the biasing member 8U. The plate spring 41 applies a force to the small diameter portion 91 of the bearing 9V to move the bearing 9V toward the photoconductor 1. The biasing member 8U includes the pressing surface portion 8*a* for directly pressing against the small diameter portion 91 of the bearing 9V. Accordingly, the development device 6X does not include the pressing member 45 depicted in FIG. 12. The bearing 9V may include a material having a low friction coefficient to decrease friction generated between the bearing 9V and the plate spring 41.

Referring to FIGS. 8 to 13, the above describes the feature elements of the development devices 6S, 6T, 6U, 6V, 6W, and 6X, respectively. However, elements other than the feature elements of the development devices 6S, 6T, 6U, 6V, 6W, and 6X are identical with the elements of the development device 6 depicted in FIG. 7, and therefore descriptions of the elements other than the feature elements of the development devices 6S, 6T, 6U, 6V, 6W, and 6X are omitted.

Referring to FIGS. 14A and 14B, 15A and 15B, 16A and 16B, 17A and 17B, and 18A and 18B, the following describes operations and effects of the development devices 6, 6S, 6T, 6U, 6V, 6W, and 6X depicted in FIGS. 7 to 13, respectively.

Figure 14A:
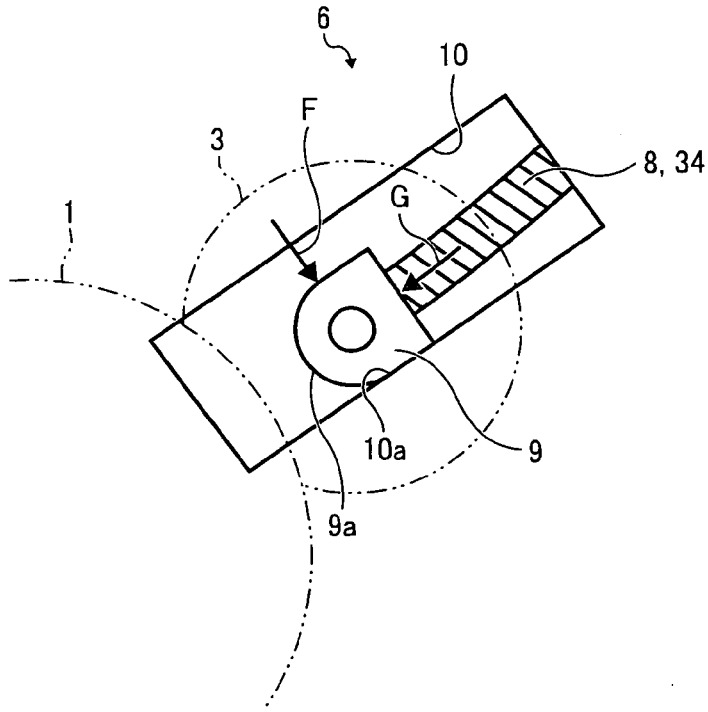
FIG. 14A is an enlarged view (according to an example embodiment) of the development device shown in FIG. 7 for explaining operations and effects of the development device.
Figure 14B:
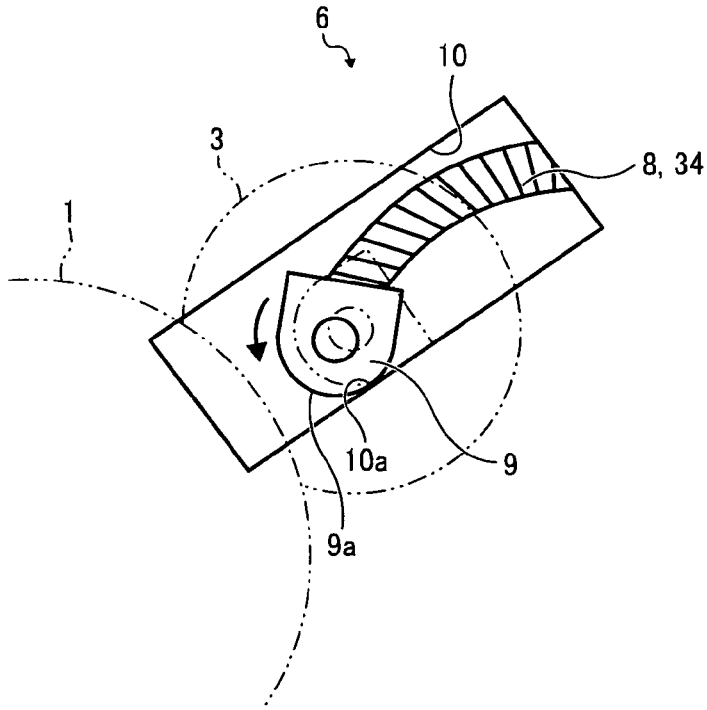
FIG. 14B is another enlarged view (according to an example embodiment) of the development device shown in FIG. 7 for explaining operations and effects of the development device.

FIGS. 14A and 14B illustrate an enlarged view of the development device 6 for explaining operations and effects of the development device 6. As illustrated in FIG. 14A, a force F generated in accordance with rotation of the development roller 3 causes the bearing 9 to contact the contact surface portion 10*a* of the guide 10. A force G applied by the coil spring 34 included in the biasing member 8 moves the bearing 9 toward the photoconductor 1. When a distance between the photoconductor 1 and the development roller 3 changes, the bearing 9 moves inside the guide 10 in a direction in which the bearing 9 moves closer to the photoconductor 1 or in a direction in which the bearing 9 moves away (e.g., separates) from the photoconductor 1 in accordance with the change in the distance between the photoconductor 1 and the development roller 3. The arc-shaped outer circumferential surface portion 9*a* of the bearing 9 facing the photoconductor 1 has an arc shape, and therefore the bearing 9 rotates while contacting the contact surface portion 10*a* of the guide 10 as illustrated in FIG. 14B.

As described above, in the development device 6, when the bearing 9 is guided by the guide 10, the bearing 9 rotates while contacting the guide 10. Accordingly, the structure of the development device 6 does not generate friction between the bearing 9 and the contact surface portion 10*a* of the guide 10 easily compared to a conventional structure of a development device in which a bearing slides along a guide without rotating. Consequently, the relatively small force G moves the bearing 9 over or along the guide 10 smoothly to cause the development roller 3 to contact the photoconductor 1 properly.

A rotation angle at which the bearing 9 rotates while the bearing 9 is guided by the guide 10 is determined based on an outer diameter of the bearing 9 and a changing amount of the distance between the photoconductor 1 and the development roller 3, as shown in a formula (1) below. In the formula (1), "d" represents the outer diameter of the bearing 9. "L" represents the changing amount of the distance between the photoconductor 1 and the development roller 3. "θ" represents the rotation angle of the bearing 9.

$$\theta = L \times 360°/d \times \pi \quad (1)$$

Generally, eccentricity of the photoconductor 1 is about 0.1 mm. Eccentricity of the development roller 3 is about 0.2 mm. Accordingly, the changing amount L of the distance between the photoconductor 1 and the development roller 3 is about 0.3 mm. The outer diameter d of the bearing 9 may vary depending on the example embodiments, but is set to 8 mm, for example. Under this condition, the rotation angle of the bearing 9 is calculated by using the formula (1) as $\theta = 0.3 \times 360°/8 \times 3.14 = 4.3°$. The greater the outer diameter d of the bearing 9 is, the smaller the rotation angle θ is.

In the development device 6, one end of the coil spring 34 in the direction perpendicular to the axial direction of the development roller 3 is attached to the bearing 9. Accordingly, when the bearing 9 rotates, the coil spring 34 is bent as illustrated in FIG. 14B. The bent coil spring 34 applies a decreased force G. However, when the rotation angle θ of the bearing 9 is about 4.3° as calculated above, the coil spring 34 applies the decreased force G decreased by about 10 percent. Namely, the bent coil spring 34 does not change (e.g., decrease) the force G substantially.

Figure 15A:
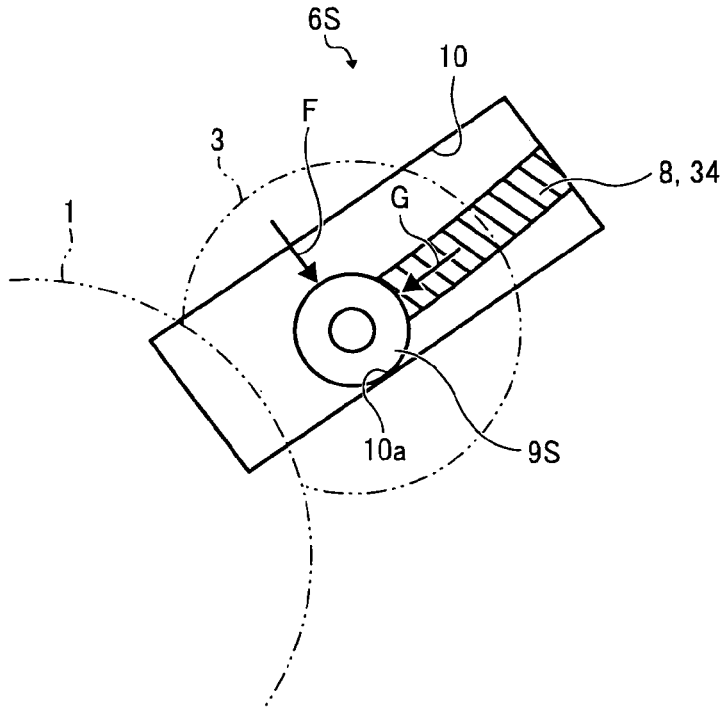
FIG. 15A is an enlarged view (according to an example embodiment) of the development device shown in FIG. 8 for explaining operations and effects of the development device.
Figure 15B:
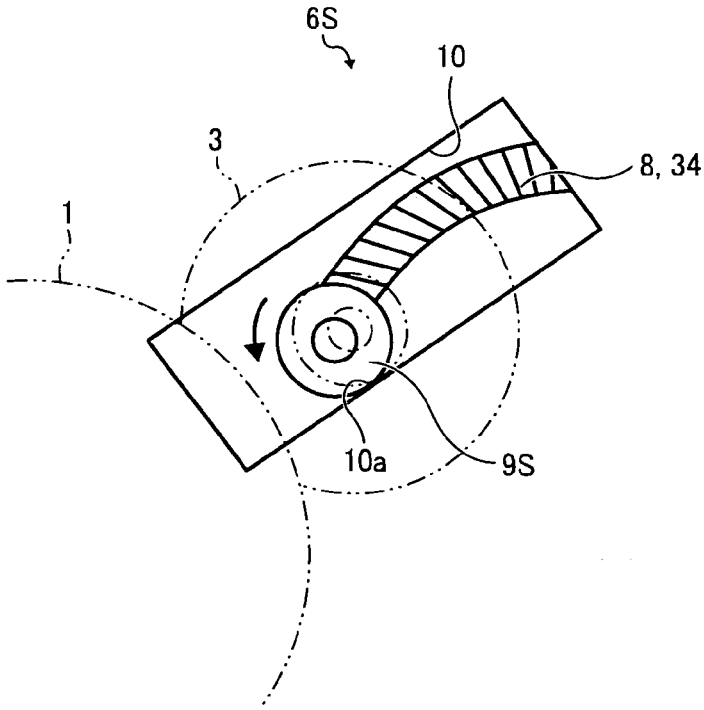
FIG. 15B is another enlarged view (according to an example embodiment) of the development device shown in FIG. 8 for explaining operations and effects of the development device.

FIGS. 15A and 15B illustrate an enlarged view of the development device 6S for explaining operations and effects of the development device 6S. As illustrated in FIG. 15A, like in the development device 6 depicted in FIGS. 14A and 14B, a force F generated in accordance with rotation of the development roller 3 causes the bearing 9S to contact the contact surface portion 10*a* of the guide 10. A force G applied by the coil spring 34 included in the biasing member 8 moves the bearing 9S toward the photoconductor 1. When a distance between the photoconductor 1 and the development roller 3 changes, the bearing 9S having a roller shape rotates and moves in a direction in which the bearing 9S moves closer to the photoconductor 1 or in a direction in which the bearing 9S moves away (e.g., separates) from the photoconductor 1 while the bearing 9S contacts the contact surface portion 10*a* of the guide 10 as illustrated in FIG. 15B.

Like in the development device 6 depicted in FIGS. 14A and 14B, in the development device 6S, the bearing 9S rotates while contacting the guide 10. Accordingly, the relatively small force G moves the bearing 9S over or along the guide 10 smoothly. Further, like in the development device 6 depicted in FIGS. 14A and 14B, when the bearing 9S rotates, the coil spring 34 is bent as illustrated in FIG. 15B. However, when the rotation angle of the bearing 9S is about 4.3° as calculated above, the bent coil spring 34 does not change (e.g., decrease) the force G substantially.

Figure 16A:
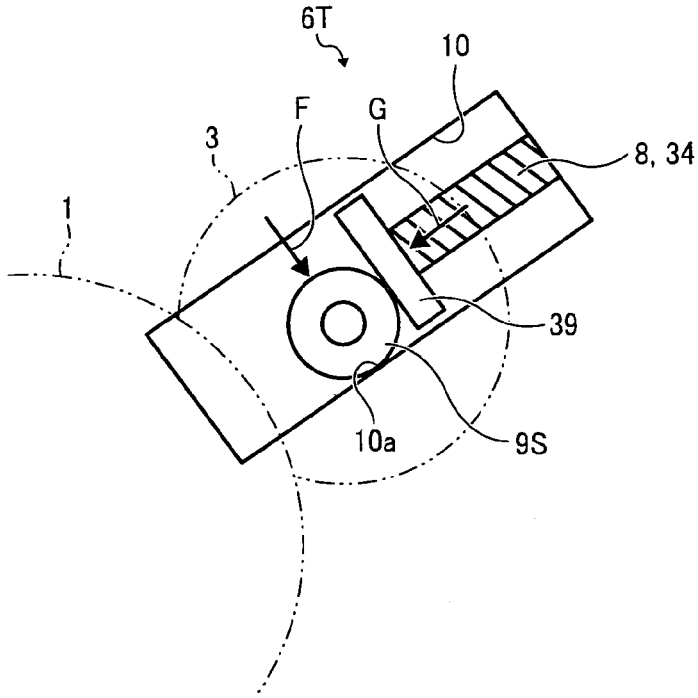
FIG. 16A is an enlarged view (according to an example embodiment) of the development device shown in FIG. 9 for explaining operations and effects of the development device.
Figure 16B:
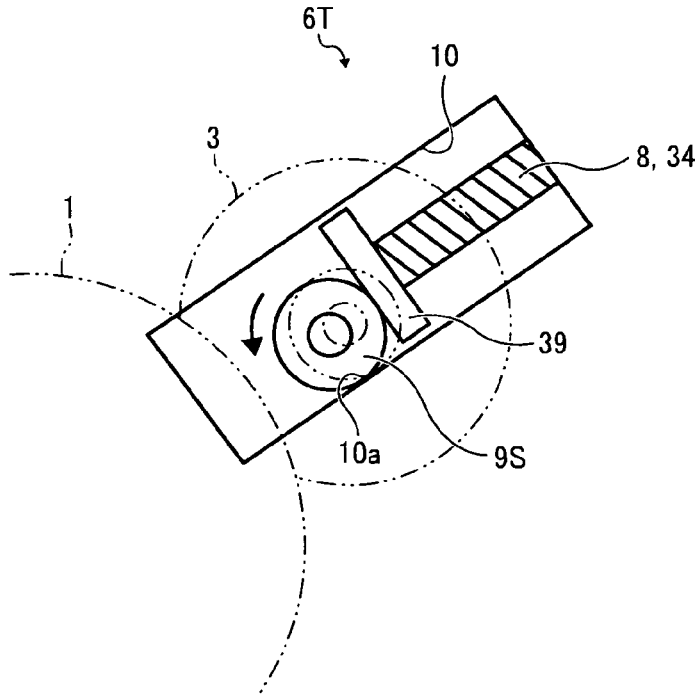
FIG. 16B is another enlarged view (according to an example embodiment) of the development device shown in FIG. 9 for explaining operations and effects of the development device.

FIGS. 16A and 16B illustrate an enlarged view of the development device 6T for explaining operations and effects of the development device 6T. As illustrated in FIG. 16A, like in the development device 6 depicted in FIGS. 14A and 14B and the development device 6S depicted in FIGS. 15A and 15B, a force F generated in accordance with rotation of the development roller 3 causes the bearing 9S to contact the contact surface portion 10*a* of the guide 10. A force G applied by the coil spring 34 included in the biasing member 8 causes the pressing member 39 to press against the bearing 9S so that the bearing 9S moves toward the photoconductor 1. When a distance between the photoconductor 1 and the development roller 3 changes, the bearing 9S having a roller shape rotates and moves in a direction in which the bearing 9S moves closer to the photoconductor 1 or in a direction in which the bearing 9S moves away (e.g., separates) from the photoconductor 1 while the bearing 9S contacts the contact surface portion 10*a* of the guide 10 as illustrated in FIG. 16B. When the bearing 9S rotates and moves inside the guide 10, the pressing member 39 presses against the bearing 9S in such a manner that the bearing 9S rotates and slides over the contact surface portion 10*a* of the guide 10.

Like in the development device 6 depicted in FIGS. 14A and 14B and the development device 6S depicted in FIGS. 15A and 15B, in the development device 6T, the bearing 9S rotates while contacting the guide 10. Accordingly, the relatively small force G moves the bearing 9S over or along the guide 10 smoothly.

In the development device 6T, the coil spring 34 presses against the bearing 9S via the pressing member 39. Accordingly, unlike in the development device 6 depicted in FIGS. 14A and 14B and the development device 6S depicted in FIGS. 15A and 15B, even when the coil spring 34 is not attached to the bearing 9S, the coil spring 34 applies the force G to the bearing 9S. In the development device 6S depicted in FIG. 15B, the coil spring 34 is bent in accordance with rotation of the bearing 9S. By contrast, in the development device 6T depicted in FIG. 16B in which the coil spring 34 is not attached to the bearing 9S, the coil spring 34 is not bent in accordance with rotation of the bearing 9S. Accordingly, the coil spring 34 applies the force G to the bearing 9S stably so that the development roller 3 supported by the bearing 9S applies toner to an electrostatic latent image formed on the photoconductor 1 uniformly.

Figure 17A:
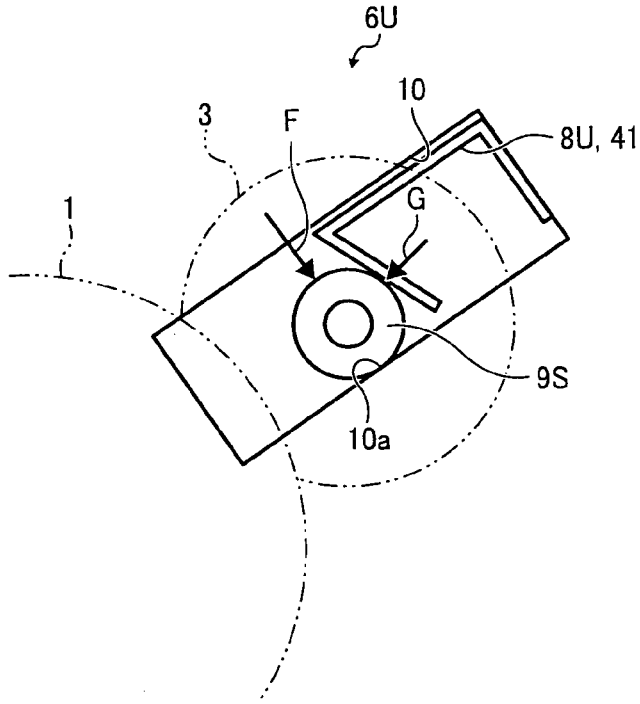
FIG. 17A is an enlarged view (according to an example embodiment) of the development device shown in FIG. 10 for explaining operations and effects of the development device.
Figure 17B:
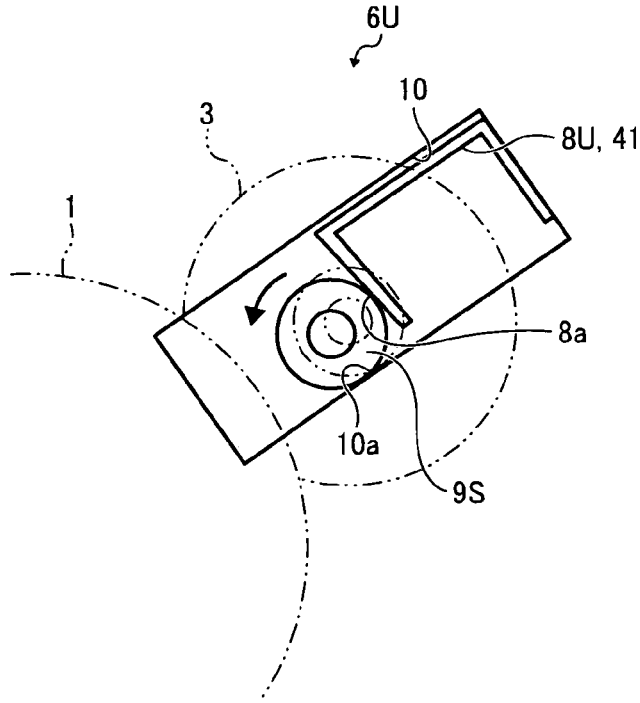
FIG. 17B is another enlarged view (according to an example embodiment) of the development device shown in FIG. 10 for explaining operations and effects of the development device.

FIGS. 17A and 17B illustrate an enlarged view of the development device 6U for explaining operations and effects of the development device 6U. As illustrated in FIG. 17A, like in the development device 6 depicted in FIGS. 14A and 14B, the development device 6S depicted in FIGS. 15A and 15B, and the development device 6T depicted in FIGS. 16A and 16B, a force F generated in accordance with rotation of the development roller 3 causes the bearing 9S to contact the contact surface portion 10*a* of the guide 10. A force G applied by the plate spring 41 included in the biasing member 8U moves the bearing 9S toward the photoconductor 1. When a distance between the photoconductor 1 and the development roller 3 changes, the bearing 9S having a roller shape rotates and moves in a direction in which the bearing 9S moves closer to the photoconductor 1 or in a direction in which the bearing 9S moves away (e.g., separates) from the photoconductor 1 while the bearing 9S contacts the contact surface portion 10*a* of the guide 10 as illustrated in FIG. 17B. When the bearing 9S rotates and moves inside the guide 10, the plate spring 41 presses against the bearing 9S at the pressing surface portion 8*a* in such a manner that the bearing 9S rotates and slides over the contact surface portion 10*a* of the guide 10.

Like in the development device 6 depicted in FIGS. 14A and 14B, the development device 6S depicted in FIGS. 15A and 15B, and the development device 6T depicted in FIGS. 16A and 16B, in the development device 6U, the bearing 9S rotates while contacting the guide 10. Accordingly, the relatively small force G moves the bearing 9S over or along the guide 10 smoothly.

In the development device 6U, the plate spring 41 serving as the biasing member 8U presses against the bearing 9S at the pressing surface portion 8*a* in such a manner that the bearing 9S rotates and slides over the contact surface portion 10*a* of the guide 10. Accordingly, unlike in the development device 6 depicted in FIGS. 14A and 14B and the development device 6S depicted in FIGS. 15A and 15B, even when the plate spring 41 serving as the biasing member 8U is not attached to the bearing 9S, the plate spring 41 applies the force G to the bearing 9S. In the development device 6S depicted in FIG. 15B, the coil spring 34 is bent in accordance with rotation of the bearing 9S. By contrast, in the development device 6U in which the plate spring 41 serving as the biasing member 8U is not attached to the bearing 9S, the biasing member 8U is not deformed (e.g., bent) in accordance with rotation of the bearing 9S. Accordingly, the biasing member 8U applies the force G to the bearing 9S stably so that the development roller 3 supported by the bearing 9S applies toner to an electrostatic latent image formed on the photoconductor 1 uniformly.

Further, in the development device 6U, the plate spring 41 applies the force G to the bearing 9S directly. In other words, the pressing member 39 depicted in FIG. 16A is omitted, resulting in reduced parts and manufacturing costs.

Figure 18A:
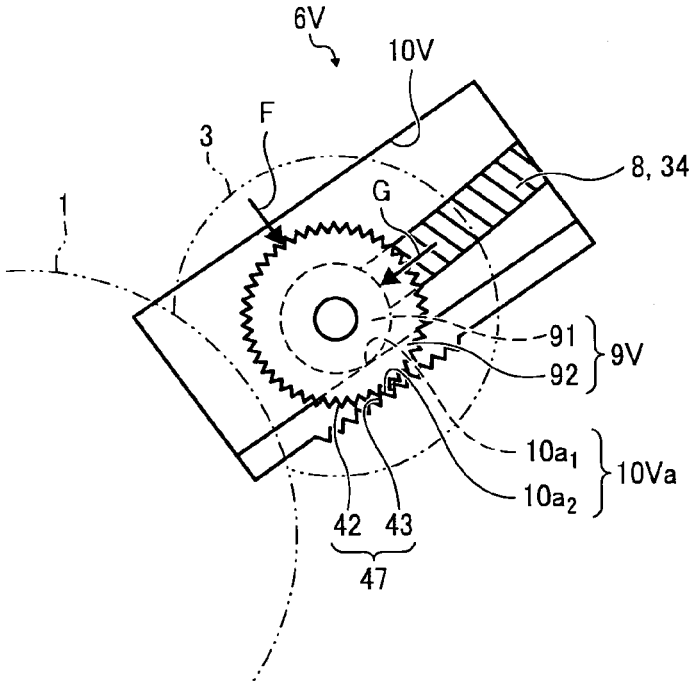
FIG. 18A is an enlarged view (according to an example embodiment) of the development device shown in FIG. 11 for explaining operations and effects of the development device.
Figure 18B:
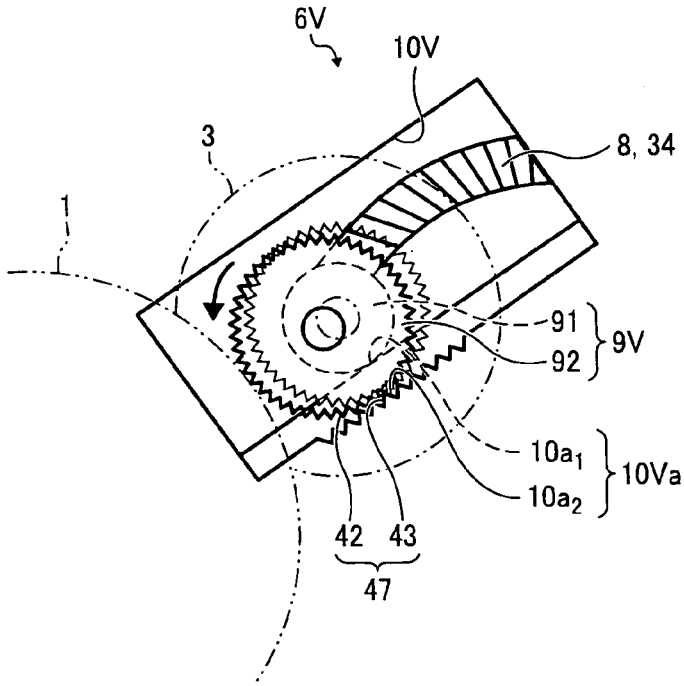
FIG. 18B is another enlarged view (according to an example embodiment) of the development device shown in FIG. 11 for explaining operations and effects of the development device.

FIGS. 18A and 18B illustrate an enlarged view of the development device 6V for explaining operations and effects of the development device 6V. As illustrated in FIG. 18A, like in the development device 6 depicted in FIGS. 14A and 14B, the development device 6S depicted in FIGS. 15A and 15B, the development device 6T depicted in FIGS. 16A and 16B, and the development device 6U depicted in FIGS. 17A and 17B, a force F generated in accordance with rotation of the development roller 3 causes the bearing 9V to contact the contact surface part 10Va of the guide 10V. For example, the small diameter portion 91 of the bearing 9V contacts the contact surface portion 10*a*1 of the contact surface part 10Va, that is, one of the two contact surface portions of the contact surface part 10Va. The large diameter portion 92 of the bearing 9V contacts the contact surface portion 10*a*2 of the contact surface part 10Va, that is, another one of the two contact surface portions of the contact surface part 10Va. When the large diameter portion 92 contacts the contact surface portion 10*a*2, the circularly-arranged set of teeth 42 provided on the large diameter portion 92 engages the straight set of teeth 43 provided on the contact surface portion 10*a*2. The coil spring 34 serving as the biasing member 8 applies a force G to the bearing 9V to move the bearing 9V toward the photoconductor 1. When a distance between the photoconductor 1 and the development roller 3 changes, the bearing 9V rotates while contacting the guide 10V as illustrated in FIG. 18B.

Like in the development device 6 depicted in FIGS. 14A and 14B, the development device 6S depicted in FIGS. 15A and 15B, the development device 6T depicted in FIGS. 16A and 16B, and the development device 6U depicted in FIGS. 17A and 17B, in the development device 6V, the bearing 9V rotates while contacting the guide 10V. Accordingly, the relatively small force G moves the bearing 9V over or along the guide 10V smoothly.

In the development device 6V, when the bearing 9V rotates, the circularly-arranged set of teeth 42 provided on the bearing 9V engages the straight set of teeth 43 provided on the guide 10V. Accordingly, the bearing 9V rotates with respect to the guide 10V precisely. Consequently, the bearing 9V does not slip on the guide 10V, and therefore the bearing 9V does not rotate in accordance with rotation of the development roller 3, preventing or reducing wear of the guide 10V. Thus, the bearing 9V moves over or along the guide 10V smoothly so that the development roller 3 supported by the bearing 9V applies toner to an electrostatic latent image formed on the photoconductor 1 uniformly. Namely, the circularly-arranged set of teeth 42 and the straight set of teeth 43 serve as the slip stopper 47 for preventing the bearing 9V from slipping on the guide 10V.

The slip stopper 47 may have other structure. For example, at least one of the bearing 9V and the guide 10V may include a material having a high friction coefficient to prevent the bearing 9V from slipping on the guide 10V. Alternatively, a sheet member having a high friction coefficient may be attached to a portion at which the bearing 9V contacts the guide 10V to prevent the bearing 9V from slipping on the guide 10V.

Also in the development devices 6W and 6X depicted in FIGS. 12 and 13, respectively, when the bearing 9V rotates, the circularly-arranged set of teeth 42 engages the straight set of teeth 43 to prevent the bearing 9V from slipping on the guide 10V. Thus, the bearing 9V rotates precisely. Further, in the development device 6W depicted in FIG. 12, the coil spring 34 applies a force to the bearing 9V via the pressing member 45. Accordingly, like in the development device 6T depicted in FIGS. 16A and 16B, the coil spring 34 is not bent in accordance with rotation of the bearing 9V. In the development device 6X depicted in FIG. 13, the plate spring 41 applies a force to the bearing 9V. Accordingly, like in the development device 6U depicted in FIGS. 17A and 17B, the biasing member 8U is not deformed in accordance with rotation of the bearing 9V, and parts included in the development device 6X are reduced.

Figure 19A:
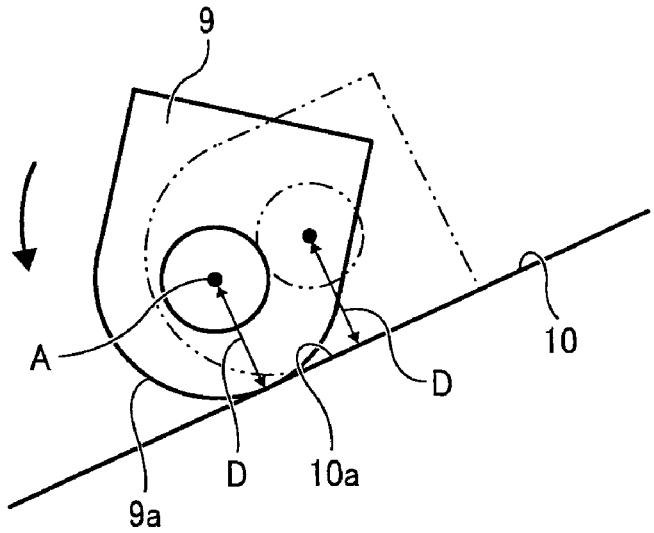
FIG. 19A is a sectional view (according to an example embodiment) of a bearing included in the development device shown in FIG. 7.
Figure 19B:
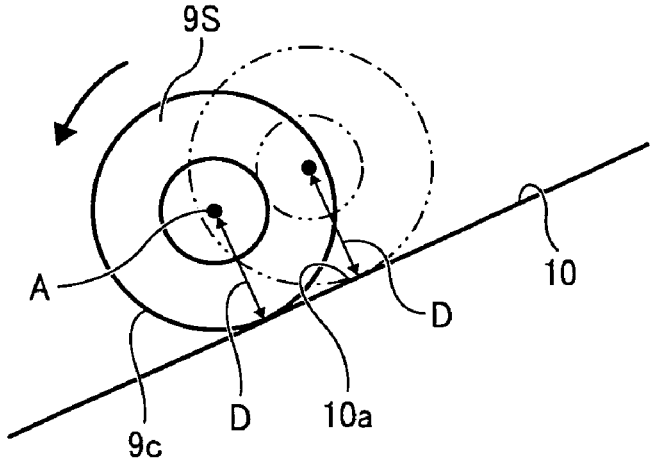
FIG. 19B is a sectional view (according to an example embodiment) of a bearing included in the development device shown in FIG. 8, the development device shown in FIG. 9, or the development device shown in FIG. 10.

Referring to FIGS. 19A and 19B, the following describes structure and movement of the bearings 9 and 9S. FIG. 19A is a sectional view of the bearing 9 included in the development device 6 depicted in FIG. 7. FIG. 19B is a sectional view of the bearing 9S included in the development device 6S depicted in FIG. 8, the development device 6T depicted in FIG. 9, or the development device 6U depicted in FIG. 10. The structure and movement of the bearing 9V included in the development device 6V depicted in FIG. 11, the development device 6W depicted in FIG. 12, or the development device 6X depicted in FIG. 13 are equivalent to the structure and movement of the bearing 9S depicted in FIG. 19B. Therefore, a diagram of the bearing 9V is omitted.

As illustrated in FIG. 19A, the arc-shaped outer circumferential surface portion 9*a* of the bearing 9 is disposed concentrically with the rotation axis A of the development roller 3 (depicted in FIG. 7) supported by the bearing 9. Similarly, as illustrated in FIG. 19B, the circular outer circumferential surface portion 9*c* of the bearing 9S is disposed concentrically with the rotation axis A of the development roller 3 supported by the bearing 9S. Accordingly, when the bearing 9 or 9S rotates while contacting the guide 10, a distance D between the rotation axis A of the development roller 3 and the contact surface portion 10*a* of the guide 10 is constant. Consequently, the development roller 3 contacts the photoconductor 1 depicted in FIG. 7 stably so that the development roller 3 applies toner to an electrostatic latent image formed on the photoconductor 1 uniformly.

According to the above-described example embodiments, when a bearing member (e.g., the bearing 9 depicted in FIG. 7, the bearing 9S depicted in FIGS. 8 to 10, or the bearing 9V depicted in FIGS. 11 to 13) is guided by a guide (e.g., the guide 10 depicted in FIGS. 7 to 10 or the guide 10V depicted in FIGS. 11 to 13), the bearing member rotates while contacting the guide. Accordingly, friction does not generate easily between the bearing member and a contact surface portion (e.g., the contact surface portion 10*a* depicted in FIGS. 7 to 10 or the contact surface part 10Va depicted in FIGS. 11 to 13) of the guide compared to a conventional structure in which a bearing member slides along a guide without rotating. Consequently, even when a relatively small force is applied to the bearing member, the small force moves the bearing member over or along the guide smoothly to suppress increase in contact pressure of a development roller (e.g., the development roller 3 depicted in FIGS. 7 to 13) applied to a photoconductor (e.g., the photoconductor 1 depicted in FIGS. 7 to 13). Thus, wear of the photoconductor and degradation of toner are suppressed, resulting in a longer life of an image forming apparatus (e.g., the image forming apparatus 12 depicted in FIG. 4) and formation of a high quality image.

According to the above-described example embodiments, a development device (e.g., the development device 6, 6S, 6T, 6U, 6V, 6W, or 6X depicted in FIG. 7, 8, 9, 10, 11, 12, or 13, respectively) includes a developer carrier (e.g., the development roller 3 depicted in FIGS. 7 to 13), a bearing member (e.g., the bearing 9 depicted in FIG. 7, the bearing 9S depicted in FIGS. 8 to 10, or the bearing 9V depicted in FIGS. 11 to 13), a biasing member (e.g., the biasing member 8 depicted in FIGS. 7 to 9, 11, and 12 or the biasing member 8U depicted in FIGS. 10 and 13), and a guide (e.g., the guide 10 depicted in FIGS. 7 to 10 or the guide 10V depicted in FIGS. 11 to 13).

The developer carrier supplies a developer to an electrostatic latent image formed on an image carrier (e.g., the photoconductor 1 depicted in FIGS. 7 to 13) to develop the electrostatic latent image into a toner image. The bearing member rotatably supports the developer carrier axially. The biasing member is provided on a side of the bearing member opposite the image carrier to apply a force to the bearing member to move the bearing member and the developer carrier toward the image carrier. The guide is disposed about the bearing member to enable the bearing member to move therebetween and guide the bearing member toward the image carrier. The bearing member includes a rotatable part (e.g., the arc-shaped outer circumferential surface portion 9*a* depicted in FIG. 7 or the circular outer circumferential surface portion 9*c* depicted in FIGS. 8 to 10) to rotate and slide over the guide while contacting the guide.

The bearing member rotating while contacting the guide prevents or reduces friction generated between the bearing member and the guide. Accordingly, even when the biasing member applies a smaller force to the bearing member, the bearing member moves over or along the guide smoothly.

The rotatable part of the bearing member for contacting the guide when the bearing member rotates may be an arc-shaped outer circumferential portion having an arc shape (e.g., the arc-shaped outer circumferential surface portion 9*a* depicted in FIG. 7) or a circular outer circumferential portion having a circular shape (e.g., the circular outer circumferential surface portion 9*c* depicted in FIGS. 8 to 10). Thus, the bearing member rotates easily while contacting the guide.

The arc-shaped outer circumferential portion or the circular outer circumferential portion of the bearing member is disposed concentrically with a rotation axis of the developer carrier supported by the bearing member.

Accordingly, when the bearing member rotates while contacting the guide, a distance between the rotation axis of the developer carrier and a contact surface portion (e.g., the contact surface portion 10*a* depicted in FIGS. 7 to 10) of the guide for contacting the bearing member is constant. Consequently, the developer carrier contacts the image carrier stably so that the developer carrier applies toner to the electrostatic latent image formed on the image carrier uniformly.

The bearing member may include a roller member which is rotatable while contacting the guide. The development device may further include a pressing member (e.g., the pressing member 39 depicted in FIG. 9 or the pressing member 45 depicted in FIG. 12) for pressing the bearing member to rotate and slide the bearing member over the guide. The biasing member applies a force to the bearing member via the pressing member.

Accordingly, the biasing member applies the force to the bearing member even when the biasing member is not attached to the bearing member. Thus, the rotating bearing member does not deform the biasing member. Consequently, the biasing member applies the force to the bearing member stably.

The bearing member may include a roller member which is rotatable while contacting the guide. The biasing member may include a substantially planar pressing portion (e.g., the pressing surface portion 8*a* depicted in FIGS. 10 and 13) for pressing the bearing member to rotate and slide the bearing member over the guide.

Accordingly, even when the biasing member is not attached to the bearing member, the biasing member applies the force to the bearing member. Since the biasing member is not attached to the bearing member, the rotating bearing member does not deform the biasing member, and the biasing member applies the force to the bearing member stably. Further, the pressing portion of the biasing member for pressing against the bearing member applies the force to the bearing member directly not via the pressing member, resulting in reduced parts and manufacturing costs.

The development device may further include a slip stopper (e.g., the slip stopper 47 depicted in FIGS. 11 to 13) for preventing the bearing member from slipping as the bearing member is guided by the guide.

The slip stopper prevents or reduces wear of the guide. Accordingly, the bearing member moves over or along the guide smoothly so that the developer carrier applies toner to the electrostatic latent image formed on the image carrier uniformly.

The slip stopper may include a first set of teeth (e.g., the circularly-arranged set of teeth 42 depicted in FIGS. 11 to 13) and a second set of teeth (e.g., the straight set of teeth 43 depicted in FIGS. 11 and 13). The first set of teeth is provided on an outer circumferential surface of the bearing member and circular or arc-shaped. The second set of teeth is provided straight in a row on the guide and disposed to engage the first set of teeth on the bearing member.

When the bearing member rotates while contacting the guide, the first set of teeth provided on the bearing member engages the second set of teeth provided on the guide. Thus, the bearing member rotates over the guide precisely. Accordingly, the bearing member does not slip on the guide, preventing or reducing wear of the guide. The bearing member moves over or along the guide smoothly so that the developer carrier applies toner to the electrostatic latent image formed on the image carrier uniformly.

The image carrier for carrying the electrostatic latent image and the developer carrier for supplying the developer to the electrostatic latent image formed on the image carrier to develop the electrostatic latent image into the toner image are integrated into a process unit (e.g., the process unit 11Y, 11C, 11M, or 11K depicted in FIG. 4) detachably attached to an image forming apparatus (e.g., the image forming apparatus 12 depicted in FIG. 4).

The process unit includes the development device. In other words, the development device is installed in the process unit detachably attached to the image forming apparatus. The image forming apparatus includes the development device. In other words, the development device is installed in the image forming apparatus.

According to the above-described example embodiments, when the bearing member is guided by the guide, the bearing member rotates while contacting the guide. Accordingly, friction may not generate between the bearing member and the guide easily compared to a conventional structure in which a bearing member such as a bearing slides over or along the guide without rotating. Consequently, a relatively small force applied to the bearing member moves the bearing member over or along the guide smoothly. In other words, the relatively small force applied to the bearing member presses the developer carrier against the image carrier precisely, suppressing increase in contact pressure applied by the developer carrier to the image carrier. Thus, wear of the image carrier and degradation of toner are suppressed, resulting in a longer life of the development device and the image forming apparatus and proper image formation performed by the development device and the image forming apparatus.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A development device comprising:

a developer carrier to supply a developer to an electrostatic latent image formed on an image carrier to develop the electrostatic latent image into a toner image;

a bearing member to rotatably support the developer carrier axially;

a biasing member provided on a side of the bearing member opposite the image carrier to apply a force to the bearing member to move the bearing member and the developer carrier toward the image carrier; and a guide having a contact surface portion and a non-contact surface portion opposite the contact surface portion, the guide being disposed about the bearing member to enable the bearing member to move therebetween and guide the bearing member toward the image carrier, wherein the non-contact surface portion is provided upstream from a nip between the developer carrier and the image carrier in a direction of rotation of the developer carrier and the bearing member does not contact the non-contact surface portion, and the bearing member comprises a rotatable part to rotate and slide over the guide while contacting the guide.

2. The development device according to claim 1, wherein the rotatable part of the bearing member comprises an arc-shaped outer circumferential portion to contact the guide when the bearing member rotates.

3. The development device according to claim 2, wherein the arc-shaped outer circumferential portion of the bearing member is disposed concentrically with a rotation axis of the developer carrier supported by the bearing member.

4. The development device according to claim 1, wherein the rotatable part of the bearing member comprises a circular outer circumferential portion to contact the guide when the bearing member rotates.

5. The development device according to claim 4, wherein the circular outer circumferential portion of the bearing member is disposed concentrically with a rotation axis of the developer carrier supported by the bearing member.

6. The development device according to claim 1, further comprising a pressing member to press the bearing member to rotate and slide the bearing member over the guide, wherein the bearing member comprises a roller member which is rotatable while contacting the guide, and the biasing member applies the force to the bearing member via the pressing member.

7. The development device according to claim 1, wherein the bearing member comprises a roller member which is rotatable while contacting the guide, and the biasing member comprises a substantially planar pressing portion to press the bearing member to rotate and slide the bearing member over the guide.

8. The development device according to claim 1, further comprising a slip stopper to prevent the bearing member from slipping as the bearing member is guided by the guide.

9. The development device according to claim 8, wherein the slip stopper comprises:

a first set of teeth provided on an outer circumferential surface of the bearing member and circular or arc-shaped; and a second set of teeth provided straight in a row on the guide and disposed to engage the first set of teeth on the bearing member.

10. A process unit detachably attached to an image forming apparatus, the process unit comprising:

an image carrier to carry an electrostatic latent image; and a development device comprising:

a developer carrier to supply a developer to the electrostatic latent image formed on the image carrier to develop the electrostatic latent image into a toner image;

a bearing member to rotatably support the developer carrier axially;

a biasing member provided on a side of the bearing member opposite the image carrier to apply a force to the bearing member to move the bearing member and the developer carrier toward the image carrier; and a guide having a contact surface portion and a non-contact surface portion opposite the contact surface portion, the guide being disposed about the bearing member to enable the bearing member to move therebetween and guide the bearing member toward the image carrier, wherein the non-contact surface portion is provided upstream from a nip between the developer carrier and the image carrier in a direction of rotation of the developer carrier and the bearing member does not contact the non-contact surface portion, and the bearing member comprising a rotatable part to rotate and slide over the guide while contacting the guide.

11. An image forming apparatus comprising:

a development device comprising:

a developer carrier to supply a developer to an electrostatic latent image formed on an image carrier to develop the electrostatic latent image into a toner image;

a bearing member to rotatably support the developer carrier axially;

a biasing member provided on a side of the bearing member opposite the image carrier to apply a force to the bearing member to move the bearing member and the developer carrier toward the image carrier; and a guide having a contact surface portion and a non-contact surface portion opposite the contact surface portion, the guide being disposed about the bearing member to enable the bearing member to move therebetween and guide the bearing member toward the image carrier, wherein the non-contact surface portion is provided upstream from a nip between the developer carrier and the image carrier in a direction of rotation of the developer carrier and the bearing member does not contact the non-contact surface portion, and the bearing member comprising a rotatable part to rotate and slide over the guide while contacting the guide.

* * * * *